US011147401B2

(12) United States Patent
Baranoff

(10) Patent No.: US 11,147,401 B2
(45) Date of Patent: Oct. 19, 2021

(54) EXPANDABLE BODY CONTOURING PILLOW

(71) Applicant: Sergei Constantine Baranoff, West Sacramento, CA (US)

(72) Inventor: Sergei Constantine Baranoff, West Sacramento, CA (US)

( * ) Notice: Subject to any disclaimer, the term of this patent is extended or adjusted under 35 U.S.C. 154(b) by 0 days.

(21) Appl. No.: 16/575,347

(22) Filed: Sep. 18, 2019

(65) Prior Publication Data

US 2020/0093295 A1 Mar. 26, 2020

Related U.S. Application Data

(60) Provisional application No. 62/733,983, filed on Sep. 20, 2018.

(51) Int. Cl.

| | |
|---|---|
| ***B65D 21/08*** | (2006.01) |
| ***A47G 9/10*** | (2006.01) |
| ***A47C 7/38*** | (2006.01) |

(52) U.S. Cl.

CPC ..... *A47G 9/1045* (2013.01); *A47C 7/383* (2013.01); *A47G 9/1081* (2013.01); *B65D 21/086* (2013.01)

(58) Field of Classification Search

CPC .... A47C 7/383; A47G 9/1045; A47G 9/1081; B65D 21/086

See application file for complete search history.

(56) References Cited

U.S. PATENT DOCUMENTS

| | | | | |
|---|---|---|---|---|
| 3,802,704 | A | 4/1974 | Genua | |
| 5,048,220 | A | 9/1991 | Harris | |
| 5,435,025 | A * | 7/1995 | Gerard | A45C 3/10 5/417 |
| 5,918,332 | A | 7/1999 | Dees | |
| 6,230,349 | B1 | 5/2001 | Silver et al. | |
| 7,131,156 | B1 | 11/2006 | Walker-Craft | |
| 10,426,242 | B1 * | 10/2019 | Little | A45F 4/02 |
| 2004/0039316 | A1 * | 2/2004 | Smith | A47C 7/383 602/6 |
| 2007/0056111 | A1 * | 3/2007 | Lastman | A47D 13/083 5/655 |

OTHER PUBLICATIONS

International Search Report and Written Opinion, PCT Application No. PCT/US 19/51794, dated Dec. 4, 2019, 11 pages.

* cited by examiner

*Primary Examiner* — David R Hare
*Assistant Examiner* — Madison Emanski
(74) *Attorney, Agent, or Firm* — Fenwick & West LLP

(57) ABSTRACT

A collapsible device comprises a flexible body configured to extend in length from a collapsed state to an extended state. In the extended state, the flexible body is bent to contour around a neck of a wearer to provide support to the neck. The flexible body has an internal, hollow chamber for storing objects within the flexible body in the collapsed state. When in the extended state, the volume of the hollow chamber increases. The flexible body further includes an open end for accessing the hollow chamber. The collapsible device further includes a slid configured to couple to the open end of the flexible body to seal the objects stored in the hollow chamber.

9 Claims, 7 Drawing Sheets

*Collapsible Device in an Open Configuration 200*

EXPANDABLE BODY CONTOURING PILLOW

CROSS REFERENCE TO RELATED APPLICATIONS

This application claims the benefit of U.S. Provisional Application No. 62/733,983, filed Sep. 20, 2018, which is incorporated by reference in its entirety.

BACKGROUND

This disclosure relates generally to a pillow, and specifically to a collapsible device configured to expand and contour around a wearer's body.

Conventional travel pillows are often comprised of solid core foam or air bladders that attempt to reduce a size of the pillow and storage space of the pillow. However, pillows comprised of solid core foam, which are often stored by being rolled up, still rely on a user finding ample space to store the rolled pillow. Although air bladder pillows require minimal space to store, they still present users with an arduous task of inflating the pillow. Accordingly, there exists a need for a pillow with minimal storage space requirements with a maintained or an improved ease of use.

The figures depict embodiments of the present disclosure for purposes of illustration only. One skilled in the art will readily recognize from the following description that alternative embodiments of the structures and methods illustrated herein may be employed without departing from the principles, or benefits touted, of the disclosure described herein.

DETAILED DESCRIPTION

A collapsible device, as described herein, is configured to address limitations of conventional pillows by easily collapsing from an extended state or a collapsed state to reduce storage space for the device while maintaining enough rigidity to support a neck of a wearer in the extended state. In embodiments described below, the collapsible device further includes a storage area for a wearer's personal items. Accordingly, the collapsible device may expand to be used as a pillow, such as during travel, and when not in use may also be collapsed to reduce space requirements and permit storage of other items inside.

Figure 1:
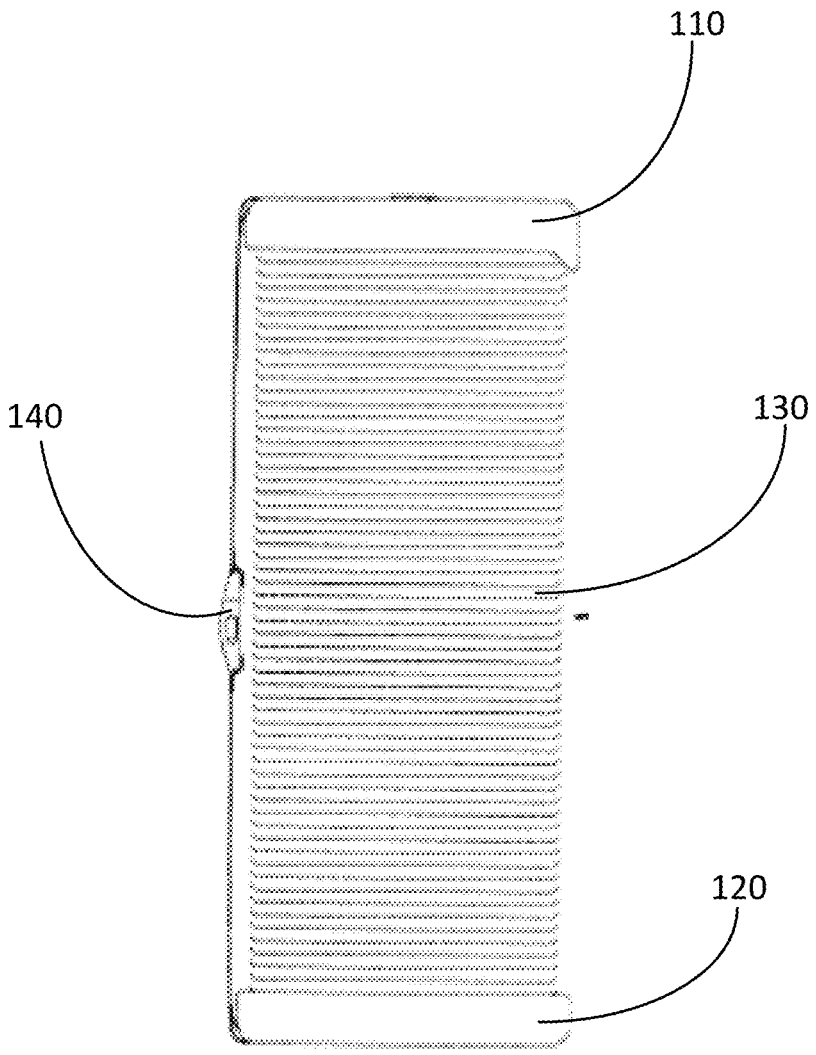
FIG. 1 is a perspective view of a collapsible device 100, according to one embodiment.

FIG. 1 is a perspective view of a collapsible device 100, according to one embodiment. In a collapsed state, for example, the configuration illustrated in FIG. 1, the collapsible device 100 may be easily stored in a user's bag (e.g., a backpack, a purse, or a suitcase). In an extended state, for example the configuration illustrated in FIG. 3, the collapsible device 100 may be contoured around a wearer's neck to provide comfortable support to the neck. In the embodiment of FIG. 1, the collapsible device 100 includes lids 110 and 120, a flexible body 130, and a strap mechanism 140.

The lids 110 and 120 are configured to seal objects in an internal cavity of the flexible body 130, hereafter referred to as a hollow chamber. The hollow chamber may be used for storing objects within the flexible body. Accordingly, in illustrated embodiment of FIG. 1, the flexible body 130 has two open ends on either side of the flexible body 130 and each of the lids 110 and 120 are configured to removably couple to ends of the flexible body 130. Uncoupling of a removable lid, for example lid 110, from an open end of the flexible body 130 allows a wearer to access the hollow chamber to place or remove objects from the chamber. In alternate embodiments, the flexible body 130 has a single open end that couples to removable lid. The opposite end of the flexible body 130 is closed.

A lid, for example lid 110, configured to couple to an open end of the flexible body 130 is designed to complement the open end of the flexible body such that the lid couples to the flexible body 130. In one embodiment, an interior wall of the lid 110 is lined with a threading complementary to a threading lining an exterior of the second end of the of the flexible body 130. In an alternate embodiment, the lid 110 includes at least one latch mechanism configured to couple to a complementary mechanism on the open end of the flexible body 130. In addition to the those described above, a lid may be coupled to an open end of the flexible body 130 using any suitable alternative coupling mechanism. In one embodiment, the coupling of the open end of the flexible tube 130 to the lid 110 creates an airtight seal around the hollow chamber that prevents objects or materials within the chamber from leaking out and prevents materials outside the chamber from leaking in. A closed end of the flexible body 130 similarly creates an airtight seal to preserve objects or materials within the chamber. In alternate embodiments, the end of the flexible body 130 corresponding to the lid 110 may be closed and the end of the flexible body corresponding to lid 120 may be the open.

Lids 110 and 120 may be comprised of a durable fabric strong enough to support the weight of objects stored within the flexible body 130, a structurally rigid material (e.g., silicon, plastics, metals), or a combination thereof. In FIG. 1, both the lids 110 and 120 are circular and the corresponding circular ends of the flexible body 130. In alternate embodiments, the lids 110 and 120 may be an alternate shape, for example squares or another polygon. The geometric dimensions of each lid may also be designed to be greater than a corresponding end of the flexible body 130 such that the lid entirely covers the corresponding end.

As described above, the flexible body 130 is a tube-like structure configured to extend in length from a collapsed state to an extended state. The interior of the flexible body 130 is a hollow chamber within which objects may be stored. Objects may be stored in the hollow chamber when the flexible body 130 is in either the collapsed state of the extended state.

FIG. 1 illustrates a flexible body 130 in a collapsed state. In one embodiment, the length of the hollow chamber extends as the flexible body extends from the collapsed state of the extended state. In a one embodiment, the flexible body 130 can be extended from a collapsed state of 8 inches long to maximum extended state of 24 inches long. More generally, in the collapsed state, the hollow chamber has sufficient volume to store a combination of a wearer's personal objects including, but not limited to, a water bottle, cellular phones, wallets, passports, keys, earphones, and the like. The collapsible device may be collapsed to the collapsed state to provide for easier transportation or storage of the collapsible device when not being used. Implementations of the collapsible device 100 in an expanded state are further described with reference to FIG. 3.

The collapsible device 100 further includes a closing mechanism 140 that has two components: a clasp and a fastener configured to couple to the clasp. In some embodiments, the closing mechanism 140 additionally has an adjustable strap. When the fastener locks with the clasp, the resulting closing mechanism may be adjusted to accommodate various implementations of the collapsible device. The clasp is attached at one end of the flexible body 130 while the fastener is attached at the opposite end of the of the flexible body 130. In the exemplary illustration of FIG. 1A, the clasp is coupled to the lid 110 and the fastener is coupled to the lid 120, however in alternate embodiments the clasp and fastener may be coupled at the opposite ends. When the flexible body 130 is compressed to the collapsed state, a locking of the fastener to the clasp secures the flexible body 130. Accordingly, in such embodiments, the flexible body 130 may not be extended from the extended state until the clasp has been unlocked from the fastener.

The closing mechanism 140, in particular the fastener, may further be configured with an adjustment mechanism that may be configured to adjust the length of the closing mechanism to adjust the length of the strap to cover greater widths or to accommodate larger users. As described above, a collapsible device 100 with a flexible body 130 in a collapsed state is convenient for the transportation of the device 100. Accordingly, the adjustment mechanism may increase the length of the closing mechanism to wrap around a shoulder of a wearer for easier transportation or may reduce the length of the closing mechanism to act as a handle for a hand of the wearer. Depending on the age, height, weight, or personal preferences of a wearer, the closing mechanism 140 may be adjusted to make the collapsible device 100 more conveniently portable.

Figure 2B:
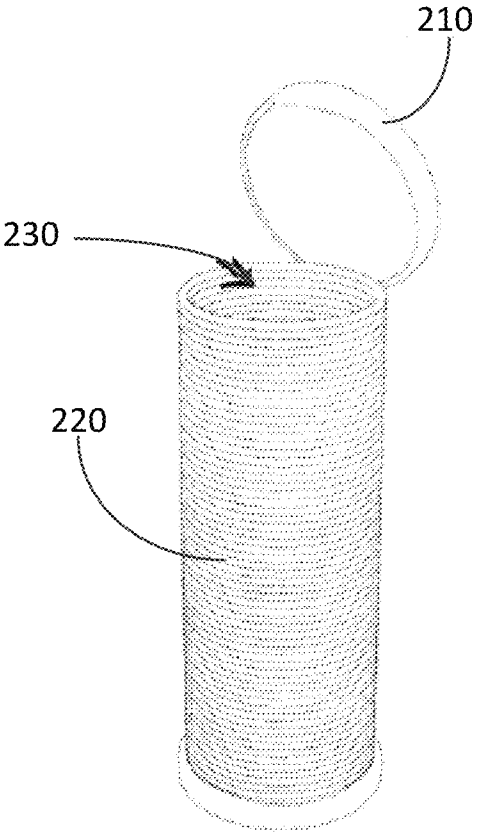
FIG. 2B is a perspective view of a collapsible device in an open configuration 200, according to one embodiment.
Figure 2A:
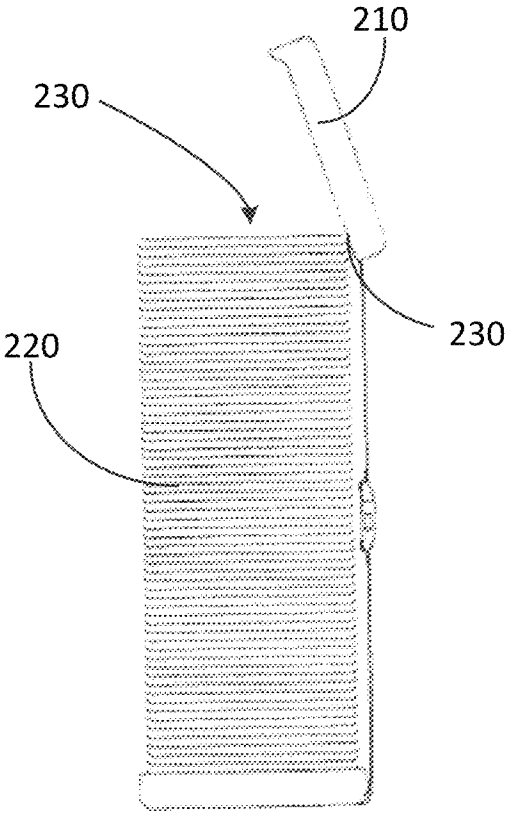
FIG. 2A is a front view of a collapsible device in an open configuration 200, according to one embodiment.

As described above, a flexible body comprises an open end which allows a wearer to access the hollow chamber and objects within the hollow chamber. To enable access to the hollow chamber, a wearer adjusts a lid configured to the open end of the flexible body to an open configuration. FIG. 2A is a front view of a collapsible device in an open configuration 200, according to one embodiment. In the illustrated embodiment of FIG. 2A, a lid 210 is coupled to an open end of a flexible body 220 at a hinge 230. In a closed configuration, the lid 210 seals the interior of the flexible body 220 and prevents objects from being placed or removed from the interior of the flexible body 220. When the lid 210 is rotated about the hinge 230 from the closed configuration, a wearer can access to a hollow chamber 230. Accordingly, in the open configuration, a wearer may place objects into the hollow chamber or remove objects from the hollow chamber. Once finished, the wearer may rotate the lid 210 back to the closed configuration, creating an air tight seal around the corresponding end of the flexible body 220. FIG. 2B is a perspective view of a collapsible device in an open configuration 200, according to one embodiment. As illustrated in FIG. 2B, the geometry of the hollow chamber 230 mirrors the geometry of the flexible chamber 220. In alternate embodiments, the hollow chamber 230 may be divided into compartments or sections configured to store particular types of objects, for example a waterproof compartment for storing electronic devices.

Figure 3:
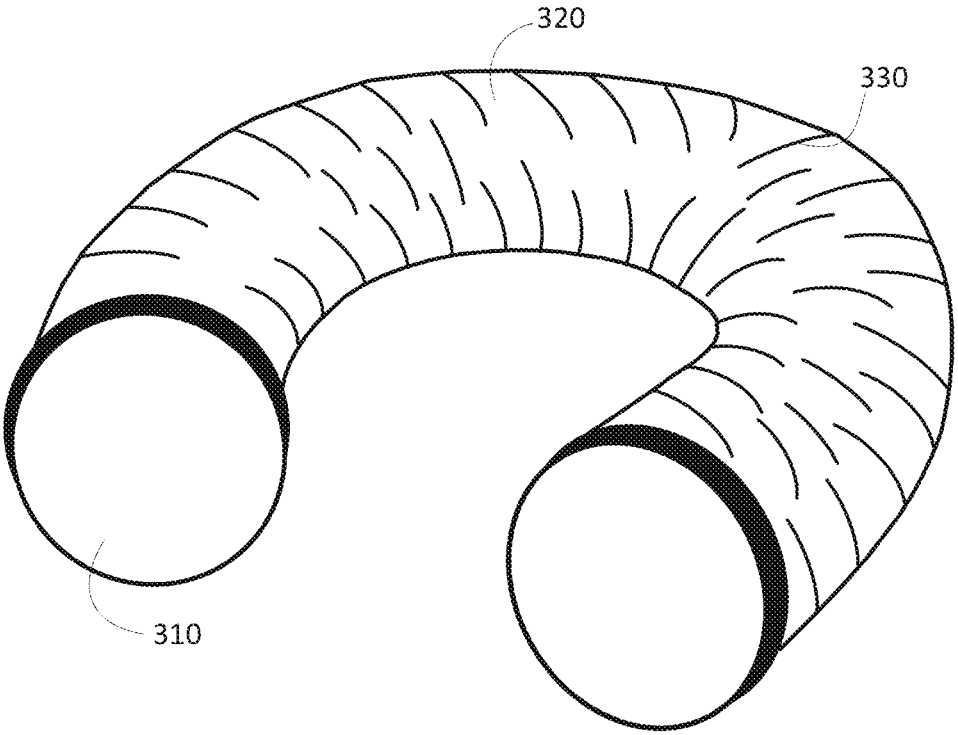
FIG. 3 is a perspective view of a collapsible device in an extended state 300, according to one embodiment.

FIGS. 1, 2A, and 2B illustrate collapsible devices with flexible bodies in a collapsed state. As described above, the flexible device may be extended from the collapsed state to an extended state. FIG. 3 is a perspective view of a collapsible device in an extended state 300, according to one embodiment. In one embodiment, the collapsible device 300, when extended, is triple the length of the collapsible device in the collapsed state. The increase in volume of the hollow chamber from the collapsed state to the extended state is proportional to the increase in length of the flexible body of the collapsible device from the collapsed state to the extended state. In some embodiments, the flexible body may be manually extended from a collapsed state to an extended state by a wearer. In alternate embodiments, the flexible body may be loaded in a spring-like state when locked into the collapsed state, for example by a closing mechanism, and automatically extend into the extended state in response to a wearer unlocking the closing mechanism. In some embodiments, the flexible body may be manually extended to intermediate lengths between the length of the collapsed state and the length of the extended state.

The illustrated embodiment of the collapsible device 300 includes a lid 310 configured to seal an open end for accessing the hollow chamber that is consistent with the description of the lids 110 and 210. Additionally, the flexible body 320 has an exterior wall facing the external environment surrounding the wearer and an interior wall lining the hollow chamber. An internal frame 330 is integrated into the interior wall of the flexibly body 320 to provide structural support to the flexible body, for example the internal frame lines the interior wall of the flexible body 320. In the collapsed state, the internal frame 330 is compressed to the length of the collapsed device. The compression of the internal frame 330 in the collapsed states increases the rigidity of the flexibly body 320, which ultimately improves the durability of the collapsible device during storage and transportation. As the flexible body 320 is extended to the extended state, the internal frame 330 proportionally extends to provide continued structural support to the extending flexibly body. In one embodiment, the internal frame 330 is a coiled spring that is compressed in the collapsed state and decompresses at a rate proportional to the extension of the flexible body.

When extended to the extended state, the flexible body 320 may be bent in various angles and orientations to form new configurations or to conform to objects of varying shapes. In such embodiments, the internal frame 330 similarly bends to the shape or to conform to an object while continuing to provide structural support to the flexible body in the new configuration. In the illustrated embodiment of FIG. 3, the flexible body 320 is bent to at a single inflection point in the center of the flexible body 320 to form a configuration resembling the letter U. In alternate embodiments, the flexible body 320 may be bent at multiple inflection points along the length of the flexible body to form the new configuration. For example, the flexible body 320 may be bent at two inflection points to form a configuration resembling the letter S. The bending and/or contouring of the flexible body 320 may be performed manually be a wearer of the collapsible device.

Additionally, the flexible body 230 may be bent to contour around an object or a part of the body, for example a neck of the wearer of the collapsible device. When the flexible body is extended to an extended state and bent into the U-shape configuration illustrated in FIG. 3, the collapsible device 300 may contour around a wearer's neck. The wearer may wrap the flexible body 320 around their neck to provide neck support when the wearer is in a seated or reclined position. Accordingly, the diameter of the flexible body 320 across the entire length of the body 320 is designed to at least equal a distance between a base of the wearer's neck and a base of the wearer's head. Stated differently, the diameter of flexible body 320 across the entire length of the collapsible device is designed to be wide enough to support a wearer's entire neck.

Anticipating that the wearer's head and neck will not remain in an upright position and, instead, may recline to an angled orientation that exerts a force on the flexible body, the internal frame 330 is designed to provide enough structural support to maintain the rigidity and structure of the flexible body in view of the exerted force. In some embodiments, the rigidity of the flexible body is additionally improved by a volume of air contained within the air tight hollow chamber sealed by the lid 310. Additionally, the external wall of the flexible body 320 may be covered with a cushioning layer, for example a plush fabric or an additional foam layer, to cushion the wearer's neck when the reclined against the flexible body 320 to improve the comfortability of contouring the collapsible device 310 around the wearer's neck. In alternate embodiments, the collapsible device 310 may be contoured around other parts of a wearer's body, for example their lower back to improve posture.

Figure 4:
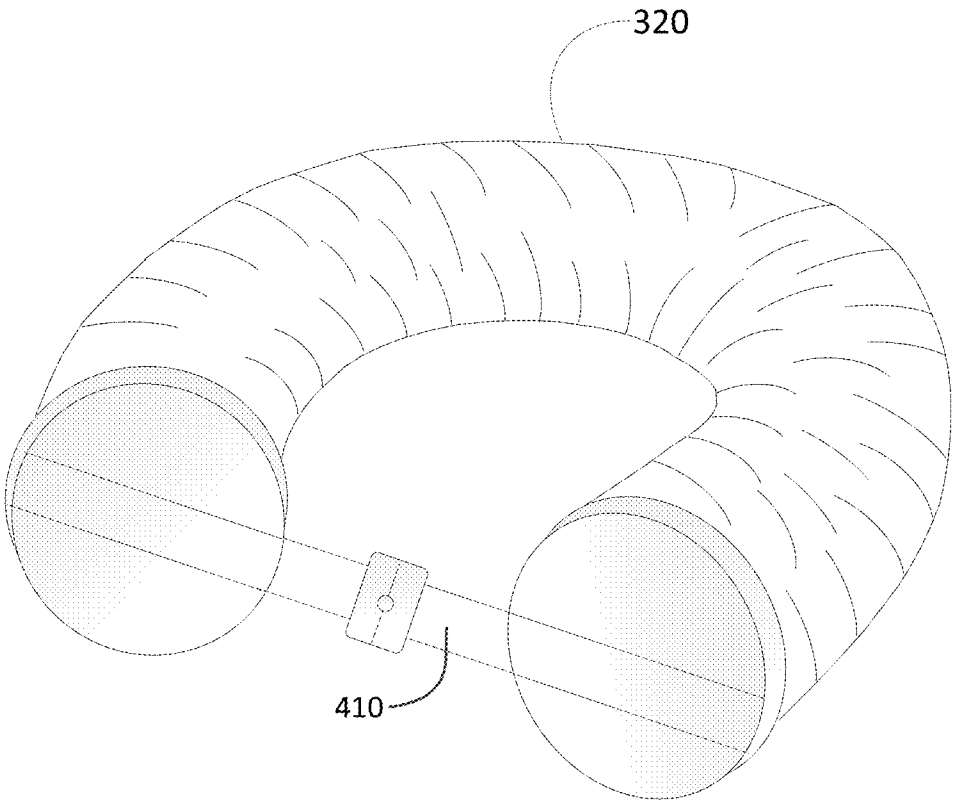
FIG. 4 is a perspective view of a collapsible device 300 in an extended state secured by a closing mechanism, according to one embodiment.

When contoured around a wearer's neck, the collapsible device 300 may slip or move relative to the wearer's neck, for example as the wearer's neck reclines or changes orientations. Accordingly, the closing mechanism used to lock the collapsible device in the collapsed state can also secure the collapsible device 300 around the neck of the wearer. FIG. 4 is a perspective view of a collapsible device 300 in an extended state secured by a closing mechanism, according to one embodiment. As described above with reference to the closing mechanism 140, a fastener is coupled to one end of the flexibly body 320 and a clasp is coupled the other end of the flexible body. When the flexible body is extended to the extended state and contoured around a wearer's neck, the ends of the flexible body align at opposite sides of the wearer's neck. Accordingly, the fastener and the clasp may be coupled across the wearer's neck to form the closing mechanism 410. The coupling of the fastener and the clasp secure the collapsible device 300 in position relative to the neck while preventing lateral displacement of the device 300.

As described with reference to FIG. 1, the closing mechanism 410 may additionally include an adjustment mechanism. When the flexible body contours a wearer's neck and is secured by the closing mechanism 410, the adjustment mechanism may be used to loosen or tighten the closing mechanism 410 to more firmly hold the collapsible device in place around the wearer's neck. Accordingly, the closing mechanism 410 enables the collapsible device to provide comfortable support to any wearer irrespective of the girth of their neck.

Figure 5A:
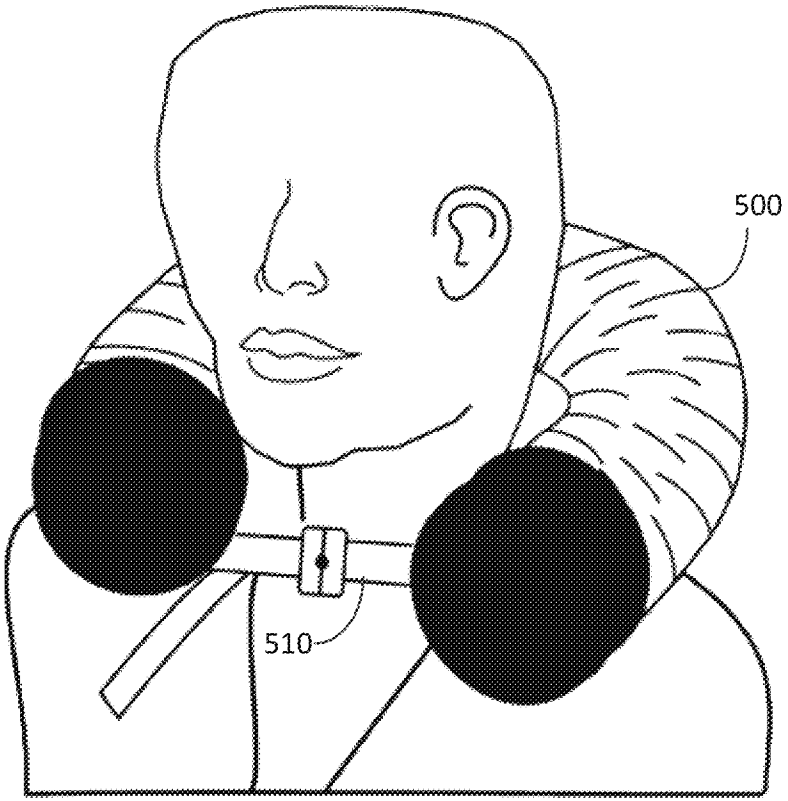
FIG. 5A is an illustration of a collapsible device in an extended state that is bent to contour around a neck of a wearer, according to one embodiment.

Consistent with the description above with reference to FIGS. 3 and 4, FIG. 5A illustrates a collapsible device 500 in an extended state that is bent to contour around a wearer's neck, according to one embodiment. The internal frame of the flexible body maintains the structural integrity of the flexible body, which provides support to the neck. A closing mechanism 510 secures the two ends of the flexible body in place relative to the neck. In the illustrated embodiment, the closing mechanism is tightened closer to the neck to further secure the device.

Figure 5B:
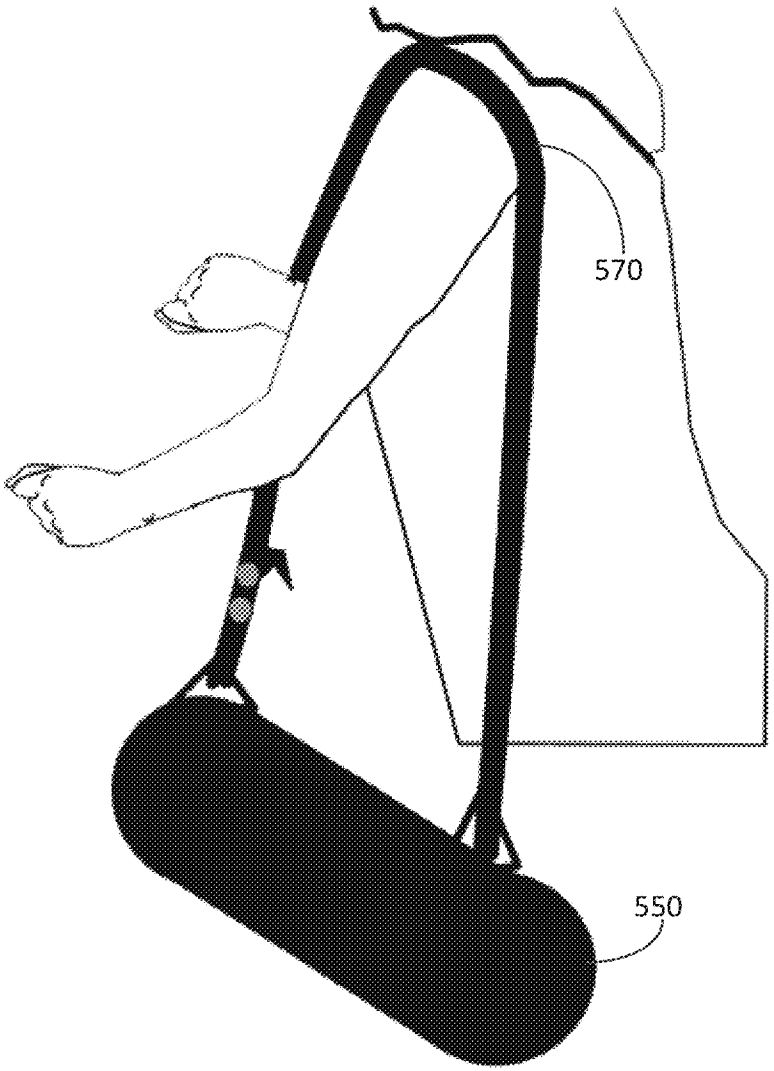
FIG. 5B illustrates a collapsible device in a collapsed state that is for transportation of the device, according to one embodiment.

Consistent with the description above with reference to FIG. 1, FIG. 5B illustrates a collapsible device 550 in a collapsed state that is conducive to transportation of the device, according to one embodiment. In the collapsed state, the closing mechanism 570 may be adjusted to a length that is long enough to be worn on a shoulder of a wearer. By carrying the collapsible device on their shoulder as illustrated, a wearer is able to carry additional items in their hands while also carrying the objects stored within the hollow chamber of the collapsible device.

Figure 6:
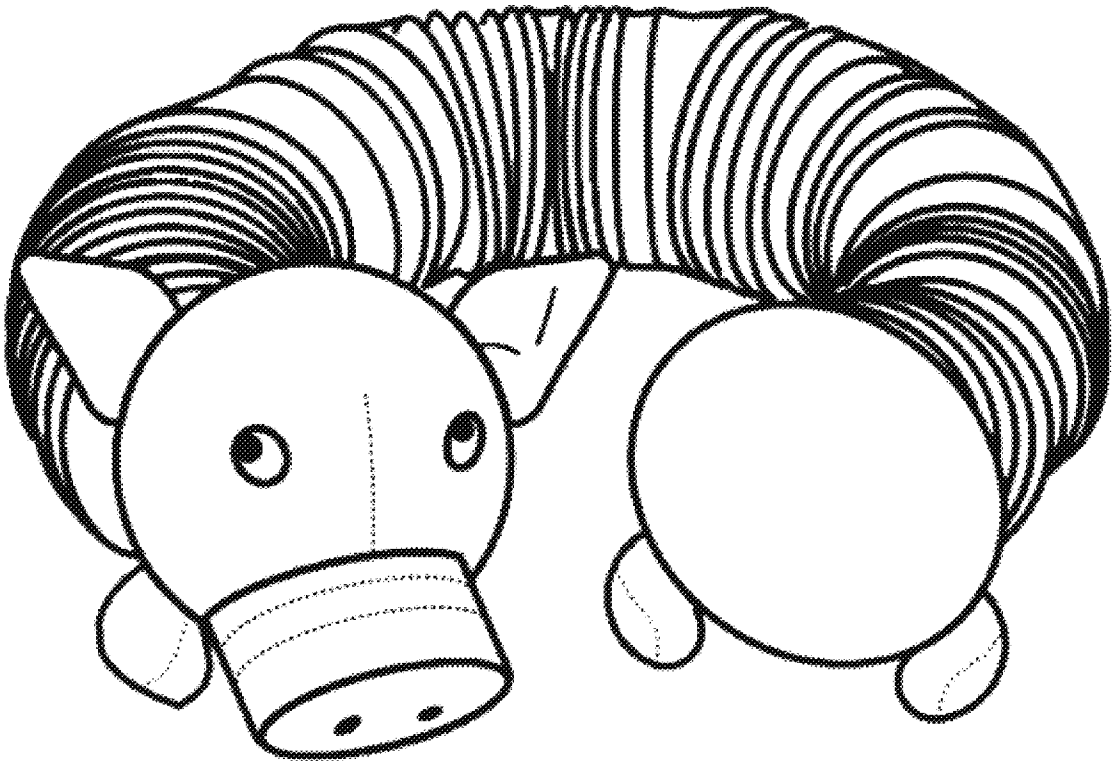
FIG. 6 illustrates a collapsible device designed to resemble an animal, according to one embodiment.

FIG. 6 illustrates a collapsible device 600 designed to resemble an animal, according to one embodiment. In particular, the collapsible device of FIG. 6 is designed to resemble a pig. In such an embodiment, a lid configured to seal the hollow chamber of the flexible body resembles a head and face of an animal and a permanent sealing piece on an opposite end of the flexible body resembles a rear of the animal. In alternate embodiments, the lid may be designed as the rear of the animal and the permanent sealing piece on the opposite end may be designed as the head and face. The exterior wall of the flexible body is covered with a cushioning layer that resembles a body of the animal. In such a design, the functionality and design of the lid and the flexible body are consistent with the embodiments illustrated in FIGS. 1-5B.

The invention claimed is:

1. A collapsible pillow device comprising: a flexible body comprising: an internal frame forming or integral with an interior wall of the flexible body, the interior wall configured to compress and decompress in extend a length such that the flexible body decompresses from a collapsed state to an extended state and compresses from the extended state to the collapsed state, wherein the flexible body and internal frame decrease in length when compressed, increase in length when decompressed, and are configured to bend, the extended state being bendable to contour around a neck of a wearer; and an internal hollow chamber for storing objects within the flexible body, the flexible body comprising an open end for accessing the internal hollow chamber, wherein the internal hollow chamber increases in volume as the internal frame and the flexible body both extend extends the length of the flexible body from the collapsed state to the extended state; and a lid configured to couple to the open end of the flexible body to seal the objects stored in the internal hollow chamber.

2. The collapsible pillow device of claim 1, further comprising a fastener attached to an end of the flexible body and a clasp attached to an opposite end of the flexible body, wherein the fastener couples to the clasp to secure the flexible body in an extended state around the neck of the wearer.

3. The collapsible pillow device of claim 2, further comprising an adjustable strap configured to reduce a length of the fastener to more firmly support the neck of the wearer at an angled orientation when contoured around the neck.

4. The collapsible pillow device of claim 3, wherein the adjustable strap increases a length of the fastener to secure the flexible body in a collapsed state around a shoulder of the wearer.

5. The collapsible pillow device of claim 4, wherein the fastener comprises an adjustable mechanism configured to increase a length of the fastener to sit securely on the shoulder of a wearer.

6. The collapsible pillow device of claim 1, wherein the interior wall of the flexible body integrates the internal frame configured to provide provides structural support to the flexible body to support the neck of the wearer at an angled orientation when contoured around the neck.

7. The collapsible pillow device of claim 1, wherein the internal frame is a coiled spring in the collapsed state and configured to uncoil in the extended state.

8. The collapsible pillow device of claim 1, wherein an exterior wall of the flexible body is covered in a cushioning layer to cushion the neck when the flexible body is contoured around the neck.

9. The collapsible pillow device of claim 1, wherein a diameter of the flexible body in the extended state is designed to support the neck of the wearer at an angled orientation when contoured around in the neck.

* * * * *